United States Patent [19]

Trieste et al.

[11] Patent Number: 4,457,522

[45] Date of Patent: Jul. 3, 1984

[54] BRIDGE SEAL FOR EXPANSION GROOVES

[76] Inventors: Mario Trieste, 37 Variek Ct., Rockville Centre, N.Y. 11570; John D. Nicholas, 835-16 A Broadway Ave., Holbrook, N.Y. 11741

[21] Appl. No.: 478,233

[22] Filed: Mar. 24, 1983

[51] Int. Cl.[3] ..... E01C 11/10; F16J 15/10

[52] U.S. Cl. ..... 277/205; 277/207 R; 404/64

[58] Field of Search ..... 277/205, 207, 237 R; 404/64–66

[56] References Cited

U.S. PATENT DOCUMENTS

| | | | |
|---|---|---|---|
| 3,653,305 | 4/1972 | Trieste et al. | 404/64 |
| 3,682,053 | 8/1972 | Kerschner | 404/65 |
| 3,881,834 | 5/1975 | Bowman | 277/207 R X |
| 3,900,677 | 8/1975 | Barber | 404/64 X |

FOREIGN PATENT DOCUMENTS

| | | | |
|---|---|---|---|
| 2505259 | 10/1975 | Fed. Rep. of Germany | 404/64 |

*Primary Examiner*—Robert S. Ward

*Attorney, Agent, or Firm*—Bauer & Amer

[57] ABSTRACT

A comparatively wide sealing strip extruded of elastomeric material that in practice is used for sealing expansion grooves in bridges or the like, having a conventional arrangement of external functional walls, and in which the internal support walls that are provided to prevent collapse in the external walls while the elastomeric construction material is curing, cooperate to form a centrally located hexagonally shaped wall arrangement that flattens out when the seal is subjected to external compressive forces, and in this way enables the seal to offer an optimum minimum resistance to change to a diminished size.

4 Claims, 6 Drawing Figures

BRIDGE SEAL FOR EXPANSION GROOVES

The present invention relates generally to sealing devices or strips for the expansion grooves of bridges or like construction, and more particularly to an improved elastomeric seal capable of achieving a sealing function in a groove of a comparatively large extent and yet still having a construction which lends itself to economical mass production by extrusion.

A typical bridge construction usually has comparatively wide expansion grooves to accommodate the extreme dimensional changes of its construction members due to temperature variation. Elastomeric sealing strips or devices, used to seal these grooves, must be of a comparable lateral extent in order to be advantageously provided with a force fit in these grooves. This size requirement seriously complicates the problem of designing an effective bridge seal and, undoubtedly, is the prime reason that the available seals are not entirely satisfactory. On the one hand, the wide cross section size dictates the use of plural internal walls with numerous interconnections therebetween so that there is no wall length or segment between such interconnections that is that large as to be vulnerable to collapse under its own weight prior to completion of the curing of the elastomeric. On the other hand, the greater the number of internal walls, the greater is the resistance of the seal to collapsing during use. In this regard, it is commercially desirable that the extruded seal readily contract under external pressure or forces. Each seal of the classification involved herein, in fact, is given a so-called "movement rating," which is related to the distance between minimum and maximum openings of the joint or opening being sealed, and the commercial objective is to meet the specification of the "movement rating" using optimum thin walls, which is, of course, the most economically extruded construction that can be produced. The seal that readily collapses during use, however, must effectively resist collapsing immediately following or during its extrusion manufacture which is when the elastomeric material has not yet had an opportunity to "cure" and thus assume its structural strength.

Broadly, it is an object of the present invention to provide an improved extruded, elastomeric seal for bridges or the like overcoming the foregoing and other shortcomings of the prior art. Specifically, it is an object to provide a seal in which the cross section has a wall arrangement providing effective internal support for the external functional walls of the seal, but without adverse effect on the ability of the seal to "give" i.e., by collapsing in size, in response to external forces exerted thereon during field use.

An improved extruded seal demonstrating objects and advantages of the present invention is of generally rectangular shape in cross-section being comprised, in combination, of (1) an arrangement of external functional walls disposed in respective locations as an upper wall, a lower wall, and a pair of opposing side walls bounding said rectangular cross-sectional shape, and (2) a cooperating arrangement of internally located support walls for said external functional walls consisting of plural walls in circumferentially space relation connected to extend radially from said functional walls towards a location centrally of the rectangular cross-sectional shape. Completing the within seal is a hexagon-shaped wall arrangement in said rectangular cross-sectional shaped central location to which the plural support walls are connected so as to stabilize their normal positions. However, in response to external forces, the support walls and to a corresponding extent the functional walls, both readily change position as permitted by the flattening out of the hexagonal-shaped wall arrangement during the collapsing in size of the seal.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 4:
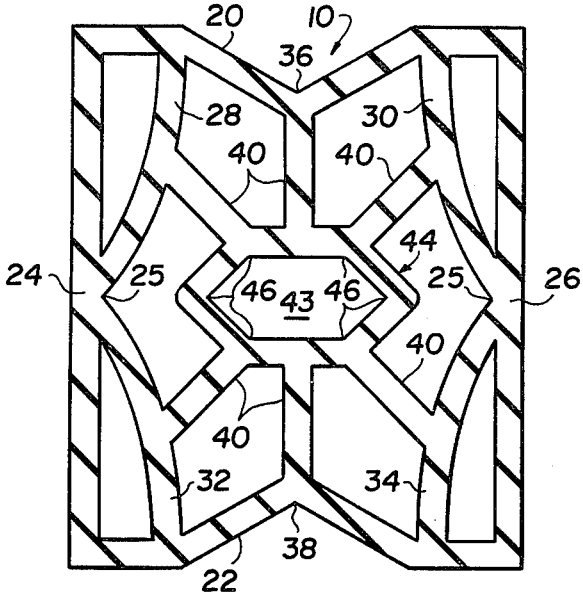
Figure 5A:
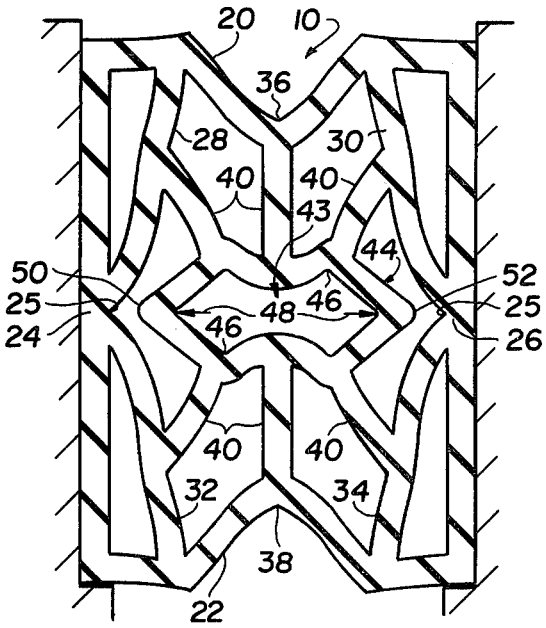
Figure 5B:
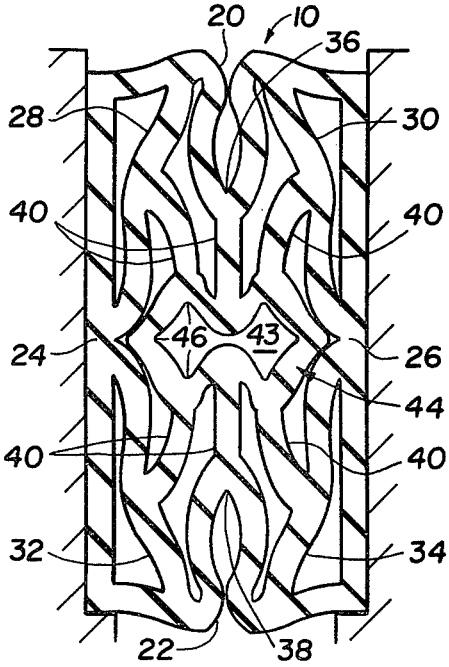

FIG. 4 is a front elevational view, on an enlarged scale and in cross-section, illustrating further structural details of an improved sealing device according to the present invention; and FIGS. 5A and 5B illustrate further structural details of said within inventive seal as well as illustrating the response thereof to external compressive forces. More particularly, FIG. 5A illustrates said improved sealing device in a slightly compressed condition, and FIG. 5B illustrates the same in an almost completely compressed condition.

Figure 1:
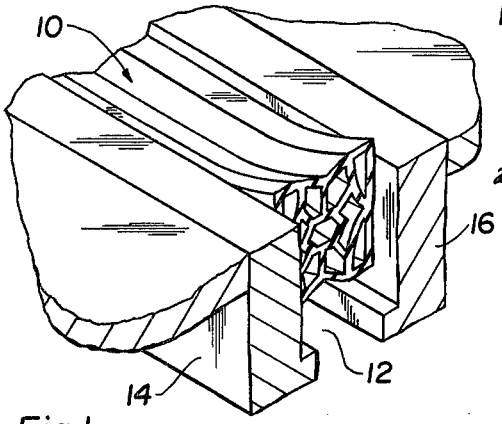
FIG. 1 is a perspective view illustrating a contemplated end use of a sealing device according to the present invention.

Reference is now made to the drawings, and in particular to FIG. 1, wherein there is shown a sealing device, generally designated 10, demonstrating objects and advantages of the present invention. As illustrated, the sealing device 10 is intended primarily for use in sealing the clearance spaces, as exemplified by space 12, between facing structural members 14 and 16 of a bridge or other such construction, although it will be understood that seal 10 is not limited to this specific end use. In this end use, however, the clearance space 12 is of a comparatively large transverse extent, in most instances exceeding at least $1\frac{3}{4}$ inches, and thus the uncompressed lateral extent of the seal 10 must also be at least this size in order for the bridge seal 10 to have a friction fit when provided with its operative sealing position between the structural members 14 and 16. This requirement of a comparatively large lateral extent in the size of the bridge seal 10 in turn necessitates that the internal wall construction thereof have a self supporting operative arrangement and design. That is, there must be adequate internal support for the external walls of the seal so that theses walls do not collapse under their own weight during the initial curing stage of the elastomeric material of which the bridge seal 10 is preferably fabricated.

Figure 2:
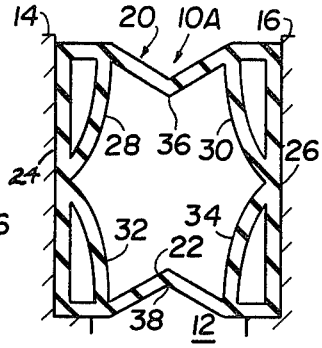
FIGS. 2 and 3 are instruction diagrams illustrating, in front elevational view, typical structural components of sealing devices in the category involved herein.
Figure 3:
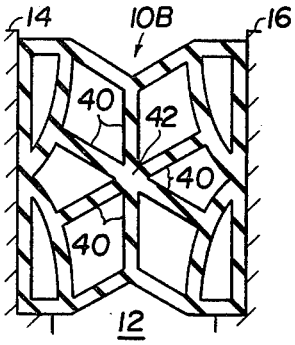

To better understand the foregoing, reference should be made to the instruction diagrams of FIGS. 2 and 3. The modification of the bridge seal 10 shown in FIG. 2, and designated 10A, is intended to illustrate what can be aptly termed the functional walls of the sealing device. That is, device 10A is generally rectangular in shape in cross-section and, as such, has functional walls disposed in appropriate locations to serve as an upper wall 20, a lower wall 22, and opposite side walls 24 and 26. Upper wall 20 and lower wall 22 are identical in their construction so that the within seal exhibits no top or bottom difference allowing it to be installed with either wall 20 as the top or wall 22. At each of the four corners, i.e. the four locations at which the upper, lower, and side walls intersect with each other, there are bowed walls 28, 30, 32, and 34 connected in spanning relation, as illustrated, between the intersecting functional walls to provide corner shapes for the seal. For completeness' sake, it should be noted that for well understood reasons, the upper and lower walls 20 and 22, respectively, are indented at their medial locations, as at 36 and 38, so that in response to external forces which urge the members 14 and 16 through closing movement towards each other, the functional walls of the seal 10A collapse internally of the rectangular shape, rather than buckling and thus projecting, particularly in the case of the upper wall 20, to a position which is outside of, or is external to, the rectangular shape of the seal.

As noted previously, the within seal cannot be constructed having just functional walls, since during extrusion these walls would collapse under their own weight as the elastomeric material is undergoing curing. As a result, it is a well understood requirement that the functional walls described and illustrated in connection with FIG. 2 be also provided with internal support walls which prevent the collapse thereof. Also to assist in obviating collapse of the external walls during curing, the seal is provided with four quadrant or corner symmetry, which contemplates equal weight distributed equally throughout the seal, which aids in the extrusion process, all as will now be described in detail.

To differentiate between the functional walls of an elastomeric seal and what is aptly characterized as the support walls for same, in FIG. 3 only said support walls are numerically designated. That is, and as should be readily apparent from comparing FIGS. 2 and 3, the seal depicted in FIG. 3, designated 10B, has the same functional walls about its periphery which bound the FIG. 2 rectangular shape thereof, and additionally includes in its internal space an operative arrangement of additional walls which have as their major purpose providing support for the functional walls immediately following extrusion, and until the elastomeric construction material has sufficiently cured so as to obviate any collapse in the functional walls. While any cooperating operative arrangement of support walls would generally achieve the objective of providing the necessary support against collapse of the external functional walls, the most commonly used operative arrangement of the support walls is that illustrated in FIG. 3 and consists of a circumferentially spaced arrangement of plural walls, individually and collectively designated 40, which, as clearly illustrated in FIG. 3, extend radially from a connection with the functional walls to a location or intersection 42 which is approximately at the center of the rectangular cross-sectional shape which characterizes the sealing device hereof.

In accordance with the description thus far provided, it should be apparent that an extruded sealing device, such as device 10, is comprised of two major components. One is an operative arrangement of functional walls, such as those described and illustrated in connection with FIG. 2, which are located about the periphery of and which bound the rectangular cross-sectional shape of the seal. The other component is the operative arrangement of the internal supporting walls 40. Merely providing these two components in combination, however, does not necessarily result in a commercially desirable seal when utilized in a field installation as illustrated in FIG. 1. By way of explanation, seal 10 being used in the manner illustrated in FIG. 1 would only be satisfactory if the internal support walls, such as walls 40, would not offer too much resistance to closing movement of the members 14 and 15. Seals, such as seal 10, are therefore provided with so-called "movement ratings," which is the distance between the minimum and maximum joint openings. A seal having the most favorable movement rating would be one requiring the least amount of pressure to collapse the seal to 85% of its normal width. It is appropriate at this point in the description to note, however, that the reduction of the resistance of the seal to external pressure cannot be achieved simply by reducing the thickness of either the functional walls (FIG. 2) or that of the supporting walls (FIG. 3), since wall thickness reduction can readily lead to collapse of the walls during the curing stage of the elastomeric construction material or other such complications.

With the above understanding of the problem, reference should now be made to FIGS. 4, 5A and 5B which illustrate in greater detail the structural details of an improved sealing device 10 according to the present invention, as well as illustrating the noteworthy manner in which this device responds to external compressive forces.

It will be understood that embodiment 10 is comprised of the operative arrangement of functional walls, as already described and illustrated in connection with FIG. 2 and also of the support walls, also as already described and illustrated in connection with FIG. 3. Thus, for brevity's sake, it is merely noted in passing that these functional walls include upper wall 20 with its indentation 36, lower wall 22 with its indentation 38, opposite side walls 24 and 26, and corner-shape retaining walls 28, 30, 32 and 34. Cooperating therewith are the plural support walls, individually and collectively designated 40. What has been added to the foregoing, and what will be understood to constitute the thrust of the within inventive contribution, is an elongated hexagonal-shaped arrangement of walls, generally designated 44, which is disposed at the central location 43 and which is connected, as at the locations individually and collectively designated 46, to the centrally disposed ends of the support walls 40, thus enabling these walls to achieve their support function. Constituted in the manner illustrated and just described in connection with FIG. 4, seal 10 is thus readily extruded since the elongated hexagon shape 44 and support walls 40 effectively prevent any possibility of collapse in the functional walls 20, 22, 24, 26, 28, 30, 32 and 34. On the other hand, and most important, by eliminating the support walls 40 terminating in a common intersection at the central location 43, there has been avoided in a noteworthy manner a significant amount of the resistance in the seal 10 against its collapsing in size in response to externally applied compressive forces. This can be readily understood from progressive examination of FIGS. 5A and 5B which respectively illustrate seal 10 in a slightly compressed and in an almost completely compressed condition. This ability in the seal 10 to yield with optimum resistance to external compressive forces is due to the flattening out of the hexagon shape 44. More particularly, this consists of separating movement 48 in the opposite corners 50 and 52 of said hexagon shape 44 and the seating of these corners in the seats 25 provided in facing relation to each of the corners 50, 52 in the walls 24, 26 as best shown in FIG. 5B.

It is also accurate to note that the favorable performance in seal 10 as just described, is also due in large measure to the elongation, in a horizontal orientation, of the hexagon shape 44. As a result of this horizontal elongation, the corners 50 and 52 are in close proximity to their respective seals 25 in their initial FIG. 4 condition and in their partially compressed FIG. 5A condition. The sealing is then readily completed in the fully compressed condition of FIG. 5B. Thus, there is no difficulty in the seal 10 achieving a fully compressed condition as illustrated in FIG. 5B, while avoiding the central congestion of the internal walls at a central intersectional point 42 as exemplified by the seal construction of FIG. 3.

Still further, and as is perhaps best illustrated in FIG. 5A, the angular orientation of the walls 40 assume a bowed configuration under external pressure and assist in projecting the corners 50 and 52 into their seats 25. There is therefore no significant opposition to movement during compression of the seal, such as a wall making physical contact with, and thus blocking movement of, the changing hexagon shape 44, which of course would manifest itself as preventing ready compression in the seal.

A latitude of modification, change and substitution is intended in the foregoing disclosure, and in some instances some feature of the invention will be employed without a corresponding use of other features. Accordingly, it is appropriate that the appended claims be construed broadly and in a manner consistent with the spirit and scope of the invention herein.

What is claimed is:

1. A sealing device for a clearance space of a comparatively large extent between two facing operative members, said sealing device being formed as an extruded elastomeric body having a wall construction of generally rectangular shape in cross-section comprising, in combination, an arrangement of functional walls disposed in respective locations as an upper wall, a lower wall, and a pair of opposing side walls bounding said rectangular cross-sectional shape, additional angularly oriented functional walls operatively arranged to retain a corner shape in each of said four corners of said rectangular cross-sectional shape disposed at each said corner bounded by intersections of said upper, lower and opposite side functional walls, and a cooperative arrangement of internally located support walls for said functional walls consisting of plural walls in circumferentially spaced relation connected to extend radially from said functional walls towards a location centrally of said rectangular cross-sectional shape, an elongated hexagonal-shaped wall arrangement in said rectangular cross-sectional shaped central location in connected relation to said plural walls so as to stabilize the normal positions thereof and having opposite pointed corners in a horizontal plane thereof and V-shaped indentations in said opposite walls in facing relation to said pointed corners to receive said pointed corners in seated relation therein, whereby in response to external forces, said hexagonal-shaped wall arrangement flattens out into said V-shaped indentations during the collapsing in size of said seal.

2. The sealing device as claimed in claim 1, wherein said upper and lower functional walls have inwardly facing indentations therein, to thereby contribute to the collapsing thereof internally of said seal.

3. The sealing device as claimed in claim 1, wherein all four corners are of identical construction to thereby equally distribute the weight of the elastomeric extrusion material and correspondingly minimize inadvertent collapse thereof during curing.

4. The sealing device as claimed in claim 3, wherein the top and bottom walls are also identically constructed, to thereby allow installation of the seal in an orientation with either one of said walls in an external position.

* * * * *

UNITED STATES PATENT AND TRADEMARK OFFICE

CERTIFICATE OF CORRECTION

PATENT NO. : 4,457,522

DATED : July 3, 1984

INVENTOR(S) : NICHOLAS, et al.

It is certified that error appears in the above-identified patent and that said Letters Patent is hereby corrected as shown below:

On the title page, "Trieste, et al" should read --Nicholas, et al --.

Signed and Sealed this

*Second* Day of *July 1985*

[SEAL]

*Attest:*

DONALD J. QUIGG

*Attesting Officer*

*Acting Commissioner of Patents and Trademarks*